US006194331B1

(12) United States Patent
Elkins

(10) Patent No.: US 6,194,331 B1
(45) **Date of Patent: *Feb. 27, 2001**

(54) FLOW-RESISTANT MATERIAL ADDITIONS TO DOUBLE-SEAM ON MACHINE-SEAMABLE FABRICS

(75) Inventor: Phillip R. Elkins, Goose Creek, SC (US)

(73) Assignee: Albany International Corp., Albany, NY (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/035,479

(22) Filed: Mar. 5, 1998

(51) Int. Cl.[7] ..... C32B 5/26

(52) U.S. Cl. ..... 442/225; 442/270; 428/193; 162/904; 139/383 AA

(58) Field of Search ..... 139/383 AA; 428/193; 442/225, 270; 162/904

(56) References Cited

U.S. PATENT DOCUMENTS 5,904,187 * 5/1999 Davenport ..... 139/383 AA

* cited by examiner

*Primary Examiner*—Terrel Morris
*Assistant Examiner*—Arti R. Singh

(74) *Attorney, Agent, or Firm*—Pitney, Hardin, Kipp & Szuch LLP

(57) ABSTRACT

An on-machine-seamable papermakers' fabric includes a first and a second base fabric, each of which is joined into endless form with a seam. The first and second base fabrics are attached to one another by at least one layer of staple fiber batt entangled therethrough such that they are offset with respect to one another in a lengthwise direction when so joined. As a consequence, seaming loops at one widthwise edge of the first base fabric coincide with a non-seam region of the second base fabric, and seaming loops at one widthwise edge of the second base fabric coincide with a non-seam region of the first base fabric. These coincident non-seam regions have additional flow-resistant material included so that when the on-machine-seamable papermakers' fabric is joined into endless form by closing both seams, it may, in the vicinities of the seams, have permeabilities to air and water substantially identical to the remainder of the fabric body thereof. Alternatively, the on-machine-seamable papermakers' fabric includes a multi-layered integrally woven base fabric having two systems of machine-direction yarns forming seaming loops in two distinct rows separated from one another in a thicknesswise direction of the fabric along each of its two widthwise edges. The two distinct rows are offset with respect to one another in a lengthwise direction of the base fabric. As a consequence, the seaming loops in one row coincide with a non-seam region of the base fabric at each widthwise edge thereof. The coincident non-seam regions, as above, have additional flow-resistant material.

58 Claims, 5 Drawing Sheets

FLOW-RESISTANT MATERIAL ADDITIONS TO DOUBLE-SEAM ON MACHINE-SEAMABLE FABRICS

BACKGROUND OF THE INVENTION

1. Field of the Invention

The present invention relates to the papermaking arts. More specifically, the present invention is a papermaker's fabric of the on-machine-seamable (OMS®) variety, such as an OMS® press fabric for the press section of a papermachine.

2. Description of the Prior Art

During the papermaking process, a fibrous web is formed by depositing a fibrous slurry, that is, an aqueous dispersion of cellulose fibers, on a moving forming fabric in the forming section of a papermachine. A large amount of water is drained from the slurry through the forming fabric during this process, leaving the fibrous web on the surface of the forming fabric.

The newly formed web proceeds from the forming section to a press section, which includes a series of press nips. The fibrous web passes through the press nips supported by a press fabric, or, as is often the case, between two press fabrics. In the press nips, the fibrous web is subjected to compressive forces which squeeze water therefrom, and which adhere the fibers in the web to one another to turn the fibrous web into a sheet. The water is accepted by the press fabric or fabrics and, ideally, does not return to the web.

The web finally proceeds to a dryer section, which includes at least one series of rotatable dryer drums or cylinders, which are internally heated by steam. The web, or newly formed paper sheet, itself is directed in a sinuous path sequentially around each in the series of drums by a dryer fabric, which holds the web closely against the surfaces of the drums. The heated drums reduce the water content of the web to a desirable level through evaporation.

It should be appreciated that the forming, press and dryer fabrics all take the form of endless loops on the papermachine and function in the manner of conveyors. It should further be appreciated that paper manufacture is a continuous process which proceeds at considerable speed. That is to say, the fibrous slurry is continuously deposited onto the forming fabric in the forming section, while a newly manufactured paper sheet is continuously wound onto rolls after it exits from the dryer section.

Referring, for the moment, specifically to press fabrics, it should be recalled that, at one time, press fabrics were supplied only in endless form. This is because a newly formed paper sheet is extremely susceptible to marking in the press nip by any nonuniformity in the press fabric or fabrics. An endless, seamless fabric, such as one produced by the process known as endless weaving, has a uniform structure in both its longitudinal (machine) and transverse (cross-machine) directions. A seam, such as a seam which may be used to close the press fabric into endless form during installation on a papermachine, represents a discontinuity in the uniform structure of the press fabric. The use of a seam, then, greatly increases the likelihood that the paper sheet will be marked in the press nip.

In brief, the seam region of any workable on-machine-seamable (OMS®) press fabric must behave under load, that is, under compression in the press nip or nips, like the rest of the press fabric, and must have the same permeability to water and to air as the rest of the press fabric, in order to prevent the periodic marking of the paper product being manufactured by the seam region. OMS® is a registered trademark of Albany International Corp.

Despite the considerable technical obstacles presented by these requirements, it remained highly desirable to develop an on-machine-seamable (OMS®) press fabric, because of the comparative ease and safety with which it could be installed on the press section. Ultimately, these obstacles were overcome with the development of press fabrics having seams formed by providing seaming loops on the crosswise edges of the two ends of the fabric. The seaming loops themselves are formed by the machine-direction (MD) yarns of the fabric. A seam is formed by bringing the two ends of the press fabric together, by interdigitating the seaming loops at the two ends of the fabric, and by directing a so-called pin, or pintle, through the passage defined by the interdigitated seaming loops to lock the two ends of the fabric together. Needless to say, it is much easier and far less time-consuming to install an OMS® press fabric, than it is to install an endless press fabric, on a papermachine.

There are several methods for producing a press fabric that can be joined on the papermachine with such a seam. One method is to flat-weave the fabric, in which case the warp yarns are the machine-direction (MD) yarns of the press fabric. To form the seaming loops, the warp ends are woven some distance back into the fabric body in a direction parallel to the warp yarns. Another technique, far more preferable, is a modified form of endless weaving, which normally is used to produce an endless loop of fabric. In modified endless weaving, the weft, or filling, yarns are continuously woven back and forth across the loom, in each passage forming a loop on one of the edges of the fabric being woven by passing around a loop-forming pin. As the weft yarn, or filling yarn, which ultimately becomes the MD yarn in the press fabric, is continuous, the seaming loops obtained in this manner are stronger than any that can be produced by weaving the warp ends back into the ends of a flat-woven fabric. In still another method, a fabric is woven endless, and the endless loop of fabric thereby obtained is flattened and given the form of two fabric layers joined to one another at two widthwise ends of the flattened loop. One or more widthwise yarns are then removed from each of the two widthwise ends to produce a short gap defined by the freed, that is, the newly unwoven portions of, lengthwise yarns at each end. These unwoven portions of the lengthwise yarns are then used as seaming loops when the two widthwise ends are brought together as described above.

Generally, the manufacture of an on-machine-seamable (OMS®) press fabric includes the attachment of a staple fiber batt to one or both sides thereof. The attachment may be effected by a process called needling (fiber locking) or hydroentangling, while the OMS® fabric is joined into endless form. Once the desired amount of staple fiber batt has been attached, the loop forming pin or pintle is removed to place the OMS® press fabric into flat form for shipment and eventual installation on a papermachine. At this time, the staple fiber batt must be cut in the vicinity of the seam to completely separate the two ends of the OMS® press fabric from one another. Often, the staple fiber batt is cut in a manner that enables it to form a flap over the seaming loops when the OMS® press fabric is rejoined into endless form. In this way, the seam region is practically indistinguishable from the rest of the paper-supporting side of the press fabric.

On the other side, the "roll" side, of the press fabric, however, some staple fiber batt must be removed from the seaming loops to facilitate the later passage of a pintle therethrough. The removal of this generally small amount of staple fiber batt, nevertheless, makes the seam region slightly more permeable to air and water than the rest of the press fabric. This difference in water permeability, or flow resistance, perhaps ever so slight, is enough to cause sheet marking in some situations.

Several approaches to solve this problem have been taken. One approach involves the use of stuffer yarns with the pintle when the OMS® press fabric is being joined into endless form on the papermachine.

When fabrics requiring high void volume and water-handling capacity are needed, such as four-layer fabrics, the use of only one seam results in a discontinuity which will mark the paper sheet. The use of two seams in an integrally woven four-layer fabric has been proposed. The two seams are aligned one on top of the other.

In another approach, an OMS® press fabric comprises two separate on-machine-seamable base fabrics, one fitting inside the loop of the other, laminated to one another during the needling process. The seam regions of the inner and outer base fabrics are offset slightly with respect to one another, so that the seam region of each will coincide with a non-seam region of the other.

After the needling process, the staple fiber batt must be cut in the vicinity of the faceside (paperside) seam to facilitate the separation of the two ends of the OMS® fabric from one another. On the other side of the faceside seam, some staple fiber must be removed from the seaming loops to facilitate the passage of a pintle therethrough when the seaming loops are meshed together.

Further, some staple fiber must also be removed from the backside of the bottom (rollside) seaming loops to facilitate the passage of a pintle through the seam formed when those seaming loops are meshed together.

All of these approaches are designed to compensate for the differences between the water permeability or flow resistance of the seam region of an OMS® press fabric and the rest or body of the press fabric. However, none of these approaches have yielded completely satisfactory results for all press types and positions and for all paper grades.

The present invention represents an alternative approach toward solving this problem.

SUMMARY OF THE INVENTION

Accordingly, the present invention is an on-machine-seamable papermakers' fabric which comprises a first base fabric and a second base fabric.

The first base fabric has a system of first machine-direction (MD) yarns and a system of first cross-machine-direction (CD) yarns, the first MD yarns being interwoven with the first CD yarns. The first base fabric has a rectangular shape with a length, a width, two lengthwise edges and two widthwise edges. The first MD yarns form first seaming loops along each of the two widthwise edges of the first base fabric.

The second base fabric, similarly, has a system of second MD yarns and a system of second CD yarns, the second MD yarns being interwoven with the second CD yarns. The second base fabric likewise has a rectangular shape with a length, a width, two lengthwise edges and two widthwise edges. The second MD yarns form second seaming loops along each of the two widthwise edges of the second base fabric.

The first and the second base fabrics have substantially equivalent lengths and widths, and are joined to one another by at least one layer of staple fiber batt entangled therethrough by needling. When so joined, the first and second base fabrics are offset with respect to one another in a lengthwise direction. As a consequence, the first seaming loops at one widthwise edge of the first base fabric coincide with a non-seam region of the second base fabric, and the second seaming loops at one widthwise edge of the second base fabric coincide with a non-seam region of the first base fabric.

In accordance with the present invention, these coincident non-seam regions of the first and second base fabrics have additional flow-resistant material included therein.

The on-machine-seamable papermakers' fabric is joined into endless form by interdigitating the first seaming loops at the two widthwise edges of the first base fabric and by directing a first pintle through the passage defined by the interdigitated first seaming loops to form a first seam, and by interdigitating the second seaming loops at the two widthwise edges of the second base fabric and by directing a second pintle through the passage defined by the interdigitated second seaming loops to form a second seam. The coincident non-seam regions, having additional flow-resistant material included therein, line up with the first and second seams and give their vicinities permeabilities to air and water substantially identical to the remainder of the on-machine-seamable papermakers' fabric.

Alternatively, the present on-machine-seamable papermakers' fabric comprises a base fabric which has a system of first machine-direction (MD) yarns, a system of second machine-direction (MD) yarns, and at least one system of cross-machine-direction (CD) yarns. The at least one system of CD yarns is interwoven with the systems of first and second MD yarns to form an integrally woven multi-layered structure in a rectangular shape with a length, a width, two lengthwise edges and two widthwise edges.

The first and second MD yarns form first and second seaming loops, respectively, in two distinct rows separated from one another in a thicknesswise direction of the fabric along each of said two widthwise edges. The two distinct rows are also offset with respect to one another in a lengthwise direction of said base fabric. As a consequence, the first seaming loops at one widthwise edge of the base fabric coincide with a non-seam region thereof, and the second seaming loops at the other widthwise edge of the base fabric coincide with another non-seam region thereof.

The coincident non-seam regions again have additional flow-resistant material included therein so that, when the on-machine-seamable papermakers' fabric is joined into the form of an endless loop by interdigitating the first seaming loops at the two widthwise edges of the base fabric with one another and by directing a first pintle through the passage defined by the interdigitated first seaming loops to form a first seam, and by interdigitated the second seaming loops at the two widthwise edges of the base fabric with one another and by directing a second pintle through the passage defined by the interdigitated second seaming loops to form a second seam, the coincident non-seam regions line up with the first and second seams and give their vicinities permeabilities to air and water substantially identical to those of the remainder of the on-machine-seamable fabric.

The present invention will now be described in more complete detail, with frequent reference being made to the drawing figures identified as follows.

DETAILED DESCRIPTION OF THE PREFERRED EMBODIMENT

Figure 1:
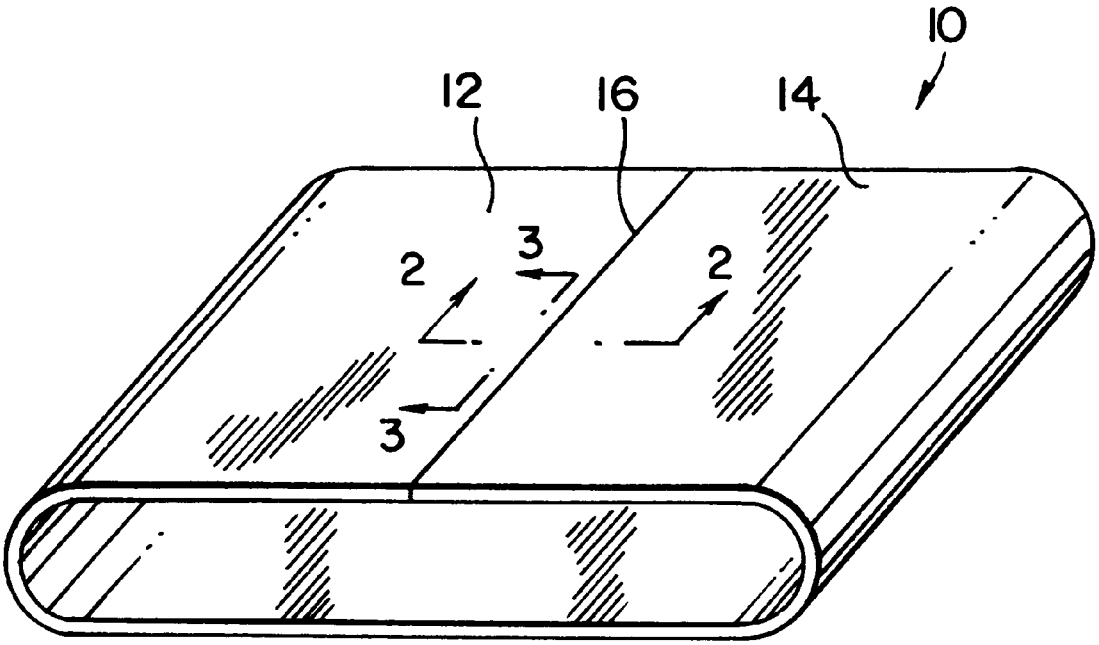
FIG. 1 is a schematic perspective view of the on-machine-seamable (OMS®) press fabric of the present invention.

Turning now specifically to the figures, FIG. 1 is a schematic perspective view of an on-machine-seamable (OMS®) papermakers' fabric 10. The fabric takes the form of an endless loop once its two ends 12,14 have been joined to one another at seam 16.

Figure 2:
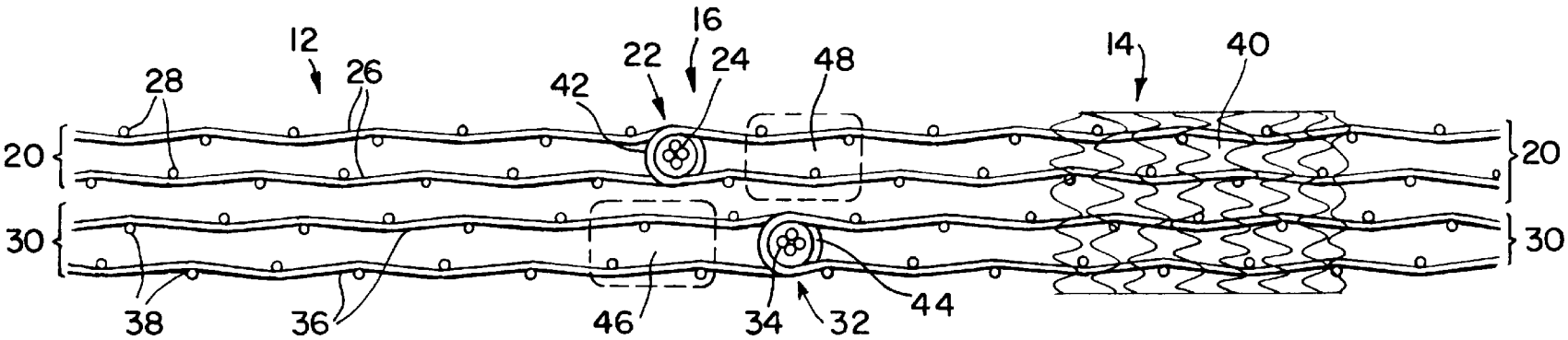
FIG. 2 is a cross-sectional view taken as indicated by line 2—2 in FIG. 1.

FIG. 2 is a cross-sectional view taken as indicated by line 2—2 in FIG. 1. Papermakers' fabric 10 is of the variety having two on-machine-seamable (OMS®) base fabrics 20,30. Outer base fabric 20 surrounds inner base fabric 30, the latter being joined into endless-loop form within the endless-loop form of the former. Inner base fabric 30 is of substantially the same length as outer base fabric 20, so that seam 32 is closed by directing pintle 34 therethrough at the same time as, or immediately before or after, seam 22 is closed by directing pintle 24 therethrough. Inner base fabric 30 and outer base fabric 20 are joined to one another by needling one or more layers of staple fiber batt into at least one of the base fabrics 20,30 to join the two base fabrics 20,30 to one another. In the interests of clarity, staple fiber batt 40 is shown in only a portion of FIG. 2, but it should be understood that it joins the inner and outer base fabrics 30,20 to one another at all points except the immediate region of the seam 16, from which batt 40 is removed during processing to facilitate the meshing of the seaming loops 42,44. Batt 40 may comprise staple fibers of any of the polymeric resins used in the production of papermachine clothing, but preferably of polyamide.

Outer base fabric 20 is woven from longitudinal, or machine-direction (MD), yarns 26 and transverse, or cross-machine direction (CD), yarns 28. MD yarns 26 form seaming loops 42 which are interdigitated and joined to one another by directing pintle 24 through the passage defined by the interdigitated seaming loops 42 to form seam 22.

In like manner, inner base fabric 30 is woven from longitudinal, or machine-direction (MD), yarns 36 and transverse, or cross-machine-direction (CD), yarns 38. MD yarns 36 form seaming loops 44 which are interdigitated and joined to one another by directing pintle 34 through the passage defined by the interdigitated seaming loops 44 to form seam 32.

Figure 3:
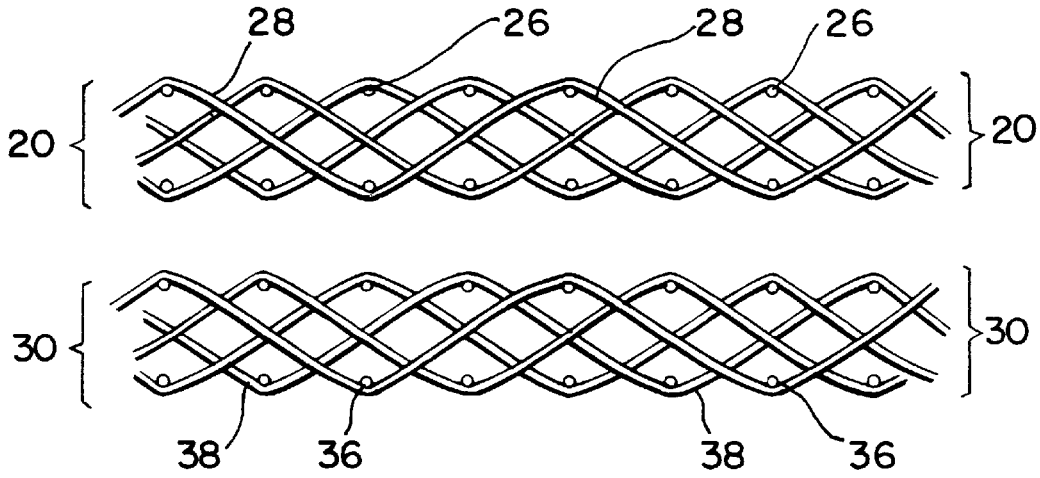
FIG. 3 is a cross-sectional view taken as indicated by line 3—3 in FIG. 1.

FIG. 3 is a cross-sectional view taken as indicated by line 3—3 in FIG. 1. Outer base fabric 20 is shown as being entirely separate from inner base fabric 30, the distance of separation being exaggerated for the sake of clarity. Staple fiber batt 40, which joins the outer base fabric 20 to the inner base fabric 30, is also omitted for the sake of clarity.

While FIG. 2 shows a fabric 10 comprising two double-layer base fabrics 20, 30, whose seams 22, 32 are offset longitudinally from one another, modifications to the embodiment shown there may be made without departing from the scope of the present invention. For example, the double-layer base fabrics 20, 30 may have MD yarns 26, 36 and/or CD yarns 28, 38 which are different from one another. Further, the two double-layer base fabrics 20, 30 may each be woven in a different weave pattern.

One of the two base fabrics 20, 30, or both, may be a single-layer fabric.

In another embodiment, an endless woven base fabric may be laminated to the top of any combination of two on-machine-seamable base fabrics having longitudinally offset seams. The endless base fabric may be of any weave pattern and include yarns of any variety.

Further, a non-woven mesh, such as that disclosed in commonly assigned U.S. Pat. No. 4,427,734, the teachings of which are incorporated herein by reference, or a spirally wound base fabric produced in accordance with the teachings of commonly assigned U.S. Pat. No. 5,360,656, the teachings of which are also incorporated herein by reference, may be laminated to the top of any combination of two on-machine-seamable base fabrics having longitudinally offset seams.

Further still, an endless woven base fabric, a non-woven mesh as disclosed in U.S. Pat. No. 4,427,734, or a spirally wound base fabric produced in accordance with the teachings of U.S. Pat. No. 5,360,656 may be laminated to the backside of any combination of two on-machine-seamable base fabrics having longitudinally offset seams.

Figure 4:
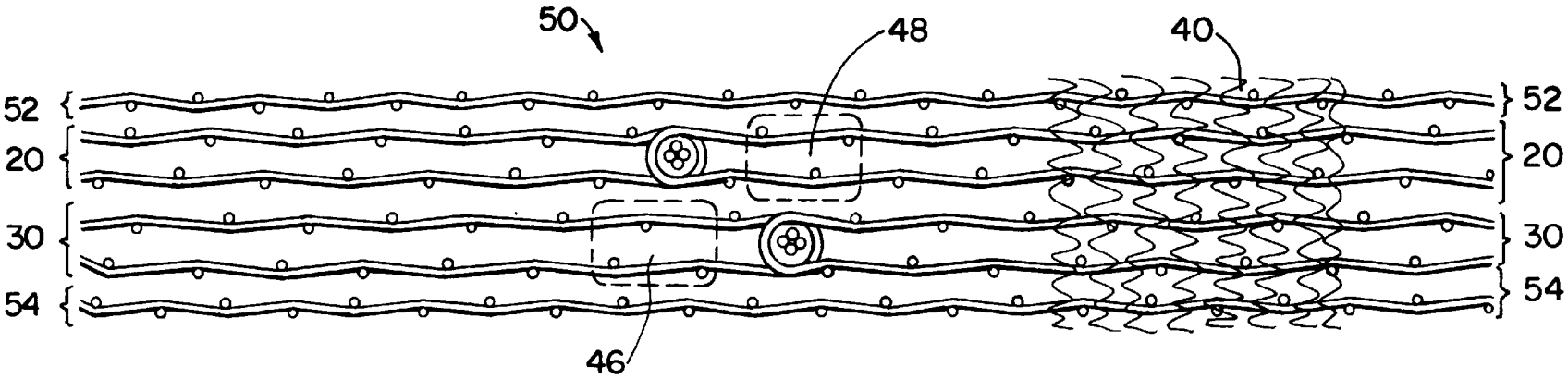
FIG. 4 is a cross-sectional view, like that given in FIG. 2, for an alternate embodiment of the present invention.

For example, FIG. 4 is a cross-sectional view, analogous to that provided in FIG. 2, for an embodiment of the present invention having an endless woven base fabric laminated to both sides of two on-machine-seamable base fabrics having longitudinally offset seams.

On-machine-seamable papermakers' fabric 50 includes an endless base fabric 52 outside of outer base fabric 20 and an endless base fabric 54 within inner base fabric 30. Endless base fabric 52, outer and inner base fabrics 20,30, and endless base fabric 54 are all joined together by batt 40 of staple fibers needled through the laminated structure. As above, batt 40 is shown in only a portion of FIG. 4 for the sake of clarity.

Finally, it should be understood that the present invention may also be practiced by using more than two on-machine-seamable base fabrics, whose seams are longitudinally offset from one another, to produce fabric 10. In such a case, and in general, the plurality (greater than two) of on-machine-seamable base fabrics are bonded or laminated together by applying staple fiber batt to one or both sides of the structure by needling.

MD yarns 26, CD yarns 28, MD yarns 36 and CD yarns 38 may each be of any of the yarn types used to weave papermachine clothing. That is to say, monofilament yarns, which are monofilament strands used singly, or plied/twisted yarns, in the form of plied monofilament or plied multifilament yarns may be used as any of these yarns.

Further, the filaments comprising MD yarns 26, CD yarns 28, MD yarns 36 and CD yarns 38 are extruded from synthetic polymeric resin materials, such as polyamide, polyester, polyetherketone, polypropylene, polyaramid, polyolefin and polyethylene terephthalate (PET) resins, and incorporated into yarns according to techniques well-known in the textile industry and particularly in the papermachine clothing industry.

Pintles 24,34 may be single strands of monofilament; multiple strands of monofilament; multiple strands of monofilament untwisted about one another, or plied, twisted, braided or knitted together; or of any of the other pintle types used to join seams in papermachine clothing. The pintles 24,34 may be extruded from synthetic polymeric resin materials, such as those listed in the preceding paragraph.

It will be observed in FIG. 2 that seam 22 in outer base fabric 20 is offset longitudinally from seam 32 in inner base fabric 30. As a consequence, the region of seam 22 in outer base fabric 20 coincides with a non-seam region 46 of the inner base fabric 30. In like manner, the region of seam 32 in inner base fabric 30 coincides with a non-seam region 48 of the outer base fabric 20.

In accordance with the present invention, non-seam regions 46,48 below and above seams 22,32, respectively, include additional flow-resistant material to compensate for the flow resistance that is lost from the seams 22,32 both in the manufacturing process and throughout life on the papermachine. In each case, flow resistance is lost because batt fiber is lost from the vicinities of the seams 22,32. During the manufacturing process, batt fiber is removed from the non-paper or bottomside of the seaming loops in the papermakers' fabric to facilitate the changing of pintles used in the manufacturing process. Batt fiber is also cleaned out of the seaming loops 42,44 to enable pintles to be directed therethrough more readily during seaming on the papermachine. Finally, when the staple fiber batt 40 is cut in the vicinity of seam 16 to create a flap thereover, some fiber is inevitably lost, resulting in lower flow resistance.

During life on the papermachine, flow resistance is lost primarily due to batt fiber wear on both the flap and no-flap side of the seam.

According to the present invention, the flow resistance in the non-seam regions 46,48 adjacent to seams 22,32, respectively, is increased by the addition of flow-resistant material to compensate for any inadequate flow resistance in seams 22,32 due to loss of batt fiber.

The flow-resistant material may take any one of a number of forms. Firstly, non-seam regions 46,48 may be provided with additional CD yarns during the weaving of the inner and outer base fabrics 30,20, or thereafter. The additional CD yarns may be monofilament, multifilament, texturized, braided, knitted or spun yarns of appropriate weight and size to provide the required level of flow resistance. They may have cross sections of circular, oval, rectangular, lobed or other shapes. The additional CD yarns may be of the same type as or different from the functional CD yarns 28,38. Further, the additional CD yarns may be woven in the same weave pattern and/or count (number per inch) or in a different weave pattern and/or count as functional CD yarns 28,38.

Secondly, monofilament, multifilament, texturized, braided, knitted or spun yarns may be sewn into the non-seam regions 46,48 to accomplish the same result as above. Again, they may have cross sections of circular, oval, rectangular, lobed or other shapes. Thirdly, a ribbon of woven or non-woven material or of polymeric film may be applied to non-seam regions 46,48 and sewn or attached thereto by an adhesive.

Finally, polymeric foams or liquid resins may be applied to non-seam regions 46,48 and cured to provide a desired additional flow resistance.

Figure 5:
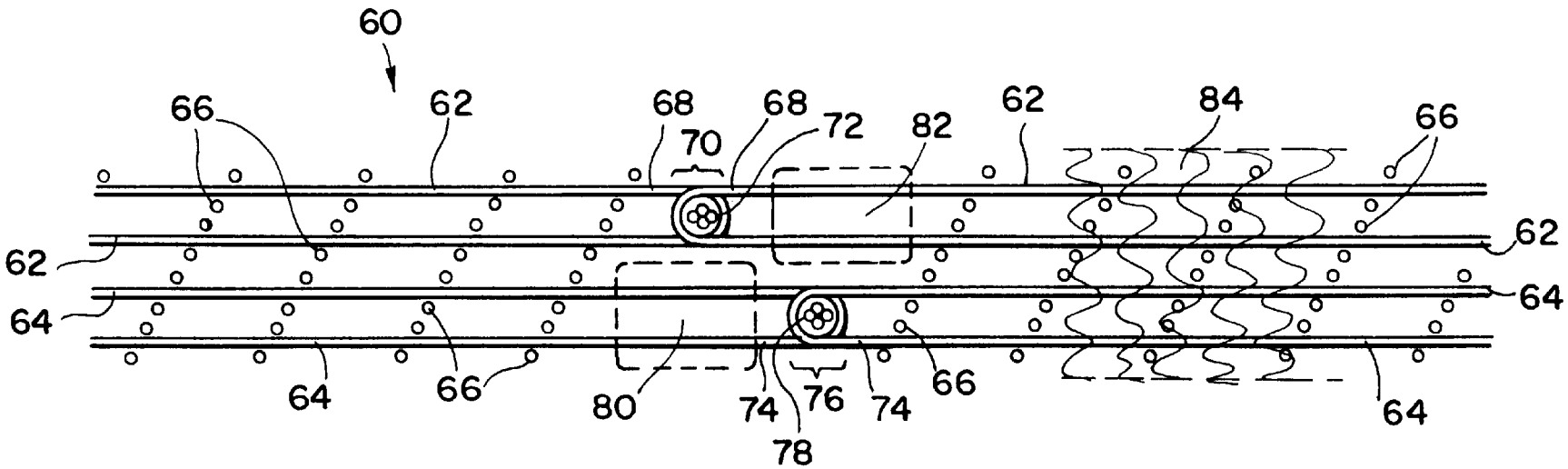
FIG. 5 is a cross-sectional view, also like that given in FIG. 2, for another embodiment of the present invention.

FIG. 5 is a cross-sectional view of another embodiment of the present invention. On-machine-seamable papermakers' fabric 60 is an integrally woven multi-layered structure comprising a system of first MD yarns 62 and a system of second MD yarns 64. The system of first MD yarns 62 and the system of second MD yarns 64 are interwoven with at least one system of CD yarns 66.

The first MD yarns 62 form first seaming loops 68 at the two ends of the fabric 60. First seaming loops 68 form first seam 70 which is closed by directing pintle 72 therethrough in the previously described and well-known manner.

In like manner, the second MD yarns 64 form second seaming loops 74 at the two ends of the fabric 60. Second seaming loops 74 form second seam 76 which is closed by directing pintle 78 therethrough.

The first seaming loops 68 and the second seaming loops 74 are separated from one another in a thicknesswise direction of the fabric 60, and are offset from one another in a longitudinal direction. As a consequence, first seam 70 coincides with non-seam region 80 and second seam 76 coincides with non-seam region 82. Batt 84 is entangled through the entire structure of fabric 60, but, for the sake of clarity, is shown in only a portion of FIG. 5.

Non-seam regions 80,82 include additional flow-resistant material of the varieties described above to compensate for the flow resistance that is lost from seam 70,76 both in the manufacturing process and throughout life on the papermachine.

Figure 6:
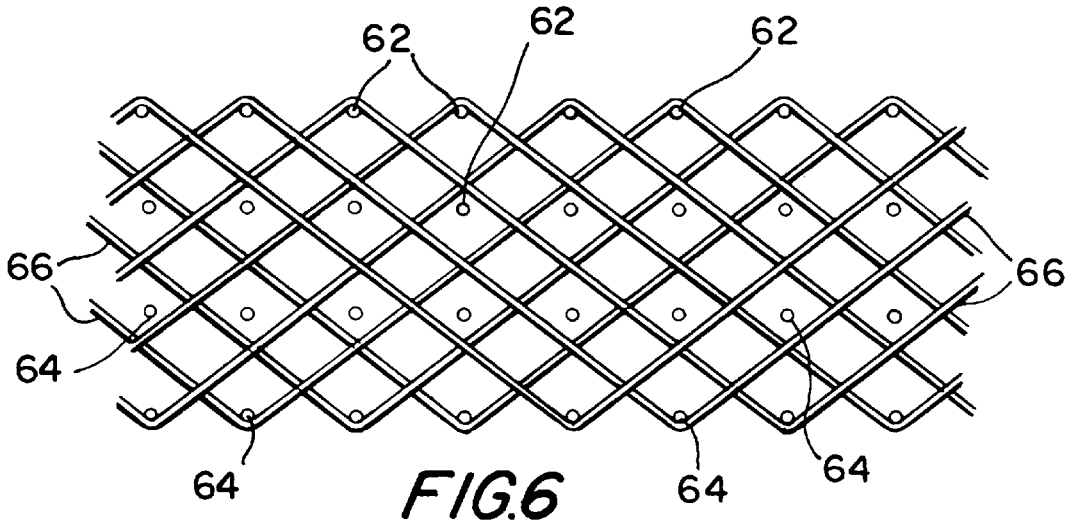
FIG. 6 is a cross-sectional view, like that given in FIG. 3, for the embodiment shown in FIG. 5.

FIG. 6 is a cross-sectional view, like that given in FIG. 3, for the embodiment shown in FIG. 5, showing the integrally woven multi-layered structure of fabric 60. The weave pattern shown is only an example of the many which may be used for this purpose.

Modifications to the above would be obvious to those of ordinary skill in the art, but would not bring the invention so modified beyond the scope of the appended claims.

What is claimed is:

1. An on-machine-seamable papermakers' fabric comprising:

a first base fabric, said first base fabric having a system of first machine-direction (MD) yarns and a system of first cross-direction (CD) yarns, said yarns of said system of first MD yarns being interwoven with said yarns of said system of first CD yarns to form said first base fabric in a rectangular shape with a length, a width, two lengthwise edges and two widthwise edges, said first MD yarns forming first seaming loops along each of said two widthwise edges;

a second base fabric, said second base fabric having a system of second MD yarns and a system of second CD yarns, said yarns of said system of second MD yarns being interwoven with said yarns of said system of second CD yarns to form said second base fabric in a rectangular shape with a length, a width, two lengthwise edges and two widthwise edges, said second MD yarns forming second seaming loops along each of said two widthwise edges;

said first base fabric and said second base fabric having substantially equivalent lengths and widths, and being joined to one another by at least one layer of staple fiber batt entangled therethrough, said first base fabric and said second base fabric being offset with respect to one another in a lengthwise direction when so joined, so that said first and second seaming loops at both of said two widthwise edges of said first and second base fabrics are likewise offset with respect to one another in a lengthwise direction, whereby said first seaming loops at one of said two widthwise edges of said first base fabric are adjacent to a non-seam region of said second base fabric, and whereby said second seaming loops at one of said two widthwise edges of said second base fabric are adjacent to a non-seam region of said first base fabric, said non-seam region of said first base fabric being a first adjacent non-seam region, and said non-seam region of said second base fabric being a second adjacent non-seam region;

said first and second adjacent non-seam regions of said first and second base fabrics, respectively, having additional flow-resistant material included therein so that, when said on-machine-seamable papermakers' fabric is joined into the form of an endless loop by interdigitating said first seaming loops at said two widthwise edges of said first base fabric and by directing a first pintle through the passage defined by the interdigitated first seaming loops to form a first seam, and by interdigitating said second seaming loops at said two widthwise edges of said second base fabric and by directing a second pintle through the passage defined by the interdigitated second seaming loops to form a second seam, said first and second seams are adjacent to said second and first adjacent non-seam regions having additional flow-resistant material therein, respectively, whereby said on-machine-seamable papermakers' fabric has, in the vicinities of said first and second pin seams, permeabilities to air and water substantially identical to the remainder thereof.

2. An on-machine-seamable papermakers' fabric as claimed in claim 1 wherein said additional flow-resistant material is additional CD yarns in said adjacent non-seam regions of said first and second base fabrics.

3. An on-machine-seamable papermakers' fabric as claimed in claim 2 wherein said additional CD yarns are incorporated into said adjacent non-seam regions of said first and second base fabrics during the weaving thereof.

4. An on-machine-seamable papermakers' fabric as claimed in claim 3 wherein said additional CD yarns are interwoven with said first and second MD yarns in a weave pattern identical to that by which said first CD yarns interweave with said first MD yarns.

5. An on-machine-seamable papermakers' fabric as claimed in claim 3 wherein said additional CD yarns are interwoven with said first and second MD yarns in a weave pattern identical to that by which said second CD yarns interweave with said second MD yarns.

6. An on-machine-seamable papermakers' fabric as claimed in claim 3 wherein said additional CD yarns are interwoven with said first and second MD yarns in a weave pattern different from that by which said first CD yarns interweave with said first MD yarns.

7. An on-machine-seamable papermakers' fabric as claimed in claim 3 wherein said additional CD yarns are interwoven with said first and second MD yarns in a weave pattern different from that by which said second CD yarns interweave with said second MD yarns.

8. An on-machine-seamable papermakers' fabric as claimed in claim 2 wherein said additional CD yarns are inserted into said adjacent non-seam regions of said first and second base fabrics after the weaving thereof.

9. An on-machine-seamable papermakers' fabric as claimed in claim 2 wherein said additional CD yarns are sewn into said adjacent non-seam regions of said first and second base fabrics after the weaving thereof.

10. An on-machine-seamable papermakers' fabric as claimed in claim 2 wherein said additional CD yarns are selected from the group of yarn varieties consisting of monofilament, multifilament, texturized, braided, knitted and spun yarns.

11. An on-machine-seamable papermakers' fabric as claimed in claim 2 wherein said additional CD yarns include yarns having cross-sectional shapes selected from the group consisting of circular, oval, rectangular and lobed shapes.

12. An on-machine-seamable papermakers' fabric as claimed in claim 2 wherein said additional CD yarns are of the same type of yarn as at least one of said first and second CD yarns.

13. An on-machine-seamable papermakers' fabric as claimed in claim 2 wherein said additional CD yarns are of a type of yarn different from at least one of said first and second CD yarns.

14. An on-machine-seamable papermakers' fabric as claimed in claim 1 wherein said additional flow-resistant material is ribbons of woven material attached to said adjacent non-seam regions of said first and second fabrics.

15. An on-machine-seamable papermakers' fabric as claimed in claim 14 wherein said ribbons of woven material are attached by sewing.

16. An on-machine-seamable papermakers' fabric as claimed in claim 14 wherein said ribbons of woven material are attached by an adhesive.

17. An on-machine-seamable papermakers' fabric as claimed in claim 1 wherein said additional flow-resistant material is ribbons of non-woven material attached to said adjacent non-seam regions of said first and second base fabrics.

18. An on-machine-seamable papermakers' fabric as claimed in claim 17 wherein said ribbons of non-woven material are attached by sewing.

19. An on-machine-seamable papermakers' fabric as claimed in claim 17 wherein said ribbons of non-woven material are attached by an adhesive.

20. An on-machine-seamable papermakers' fabric as claimed in claim 1 wherein said additional flow-resistant material is ribbons of polymeric film attached to said adjacent non-seam regions of said first and second base fabrics.

21. An on-machine-seamable papermakers' fabric as claimed in claim 20 wherein said ribbons of polymeric film are attached by sewing.

22. An on-machine-seamable papermakers' fabric as claimed in claim 20 wherein said ribbons of polymeric film are attached by an adhesive.

23. An on-machine-seamable papermakers' fabric as claimed in claim 1 wherein said additional flow-resistant material is a polymeric foam in said adjacent non-seam regions of said first and second base fabrics.

24. An on-machine-seamable papermakers' fabric as claimed in claim 1 wherein said additional flow-resistant material is a cured liquid resin in said adjacent non-seam regions of said first and second base fabrics.

25. An on-machine-seamable papermakers' fabric as claimed in claim 1 wherein at least one of said first and second base fabrics is a double-layer base fabric.

26. An on-machine-seamable papermakers' fabric as claimed in claim 1 wherein said first and second base fabrics are double-layer base fabrics.

27. An on-machine-seamable papermakers' fabric as claimed in claim 26 wherein said first MD yarns of said first base fabric are different from said second MD yarns of said second base fabric.

28. An on-machine-seamable papermakers' fabric as claimed in claim 26 wherein said first CD yarns of said first base fabric are different from said second CD yarns of said second base fabric.

29. An on-machine-seamable papermakers' fabric as claimed in claim 26 wherein said first base fabric is woven in a same weave pattern as said second base fabric.

30. An on-machine-seamable papermakers' fabric as claimed in claim 26 wherein said first base fabric is woven in a different weave pattern from said second base fabric.

31. An on-machine-seamable papermakers' fabric as claimed in claim 1 wherein at least one of said first and second base fabrics is a single-layer base fabric.

32. An on-machine-seamable papermakers' fabric as claimed in claim 1 wherein said on-machine-seamable papermakers' fabric is joined into the form of an endless loop having an inside and an outside and further comprising an endless woven base fabric laminated to at least one of said inside and outside by at least one layer of staple fiber batt entangled therethrough.

33. An on-machine-seamable papermakers' fabric as claimed in claim 1 wherein said on-machine-seamable papermakers' fabric is joined into the form of an endless loop having an inside and an outside and further comprising a non-woven mesh laminated to at least one of said inside and outside by at least one layer of staple fiber batt entangled therethrough.

34. An on-machine-seamable papermakers' fabric as claimed in claim 1 wherein said on-machine-seamable papermakers' fabric is joined into the form of an endless loop having an inside and an outside and further comprising a spirally wound base fabric laminated to at least one of said inside and outside by at least one layer of staple fiber batt entangled therethrough.

35. An on-machine-seamable papermakers' fabric as claimed in claim 1 further comprising a third base fabric, said third base fabric having a system of third MD yarns and a system of third CD yarns, said yarns of said system of third MD yarns being interwoven with said yarns of said system of third CD yarns to form said third base fabric in a rectangular shape with a length, a width, two lengthwise edges and two widthwise edges, said third MD yarns forming third seaming loops along each of said two widthwise edges;

said third base fabric having a length and a width substantially equivalent to those of said first and second base fabrics, and being joined to said first and second base fabrics by at least one layer of staple fiber batt entangled therethrough, said third base fabric being offset with respect to said first and second base fabrics in a lengthwise direction when so joined, so that said third seaming loops at both of said two widthwise edges of said third base fabric are likewise offset in a lengthwise direction with respect to said first and second seaming loops at both of said two widthwise edges of said first and second base fabrics, whereby said third seaming loops at one of said two widthwise edges of said third base fabric are adjacent to non-seam regions of said first and second base fabrics, and said first seaming loops at one of said two widthwise edges of said first base fabric are adjacent to a non-seam region of said third base fabric, and said second seaming loops at one of said two widthwise edges of said second base fabric are adjacent to a non-seam region of said third base fabric;

said adjacent non-seam regions of said first, second and third base fabrics having additional flow-resistant material included therein so that, when said on-machine-seamable papermakers' fabric is joined into the form of an endless loop by interdigitating said first seaming loops at said two widthwise edges of said first base fabric and by directing a first pintle through the passage defined by the interdigitated first seaming loops to form a first seam; and by interdigitating said second seaming loops at said two widthwise edges of said second base fabric and by directing a second pintle through the passage defined by the interdigitated second seaming loops to form a second seam; and by interdigitating said third seaming loop at said two widthwise edges of said third base fabric and by directing a third pintle through the passage defined by the interdigitated third seaming loops to form a third seam, said first seam is adjacent to non-seam regions having additional flow-resistant material therein in said second and third base fabrics; said second seam is adjacent to non-seam regions having additional flow-resistant material therein in said first and third base fabrics; and said third seam is adjacent to non-seam regions having additional flow-resistant material therein in said first and second base fabrics, whereby said on-machine-seamable papermakers' fabric has, in the vicinities of said first, second and third seams, permeabilities to air and water substantially identical to the remainder thereof.

36. An on-machine-seamable papermakers' fabric comprising:

a base fabric, said base fabric having a system of first machine-direction (MD) yarns, a system of second machine-direction (MD) yarns, and at least one system of cross-machine-direction (CD) yarns, said at least one system of CD yarns being interwoven with said systems of first and second MD yarns to form an integrally woven multi-layered structure in a rectangular shape with a length, a width, two lengthwise edges and two widthwise edges, said first and second MD yarns forming first and second seaming loops, respectively, in two distinct rows separated from one another in a thicknesswise direction of the fabric along each of said two widthwise edges thereof, said two distinct rows being offset with respect to one another in a lengthwise direction of said base fabric, so that said first seaming loops at one widthwise edge of said base fabric are adjacent to a non-seam region thereof, and said second seaming loops at the other widthwise edge of said base fabric are adjacent to another non-seam region thereof, said two non-seam being adjacent non-seam regions, said adjacent non-seam regions having additional flow-resistant material included therein so that, when said on-machine-seamable papermakers' fabric is joined into the form of an endless loop by interdigitating said first seaming loops at said two widthwise edges of said base fabric with one another and by directing a first pintle through the passage defined by the interdigitated first seaming loops to form a first seam, and by interdigitating said second seaming loops at said two widthwise edges of said base fabric with one another and by directing a second pintle through the passage defined by the interdigitated second seaming loops to form a second seam, said first and second seams are each adjacent to one of said adjacent non-seam regions having additional flow-resistant material therein, whereby said on-machine-seamable papermakers' fabric has, in the vicinities of said first and second seams, permeabilities to air and water substantially identical to the remainder thereof.

37. An on-machine-seamable papermakers' fabric as claimed in claim 36 wherein said additional flow-resistant material is additional CD yarns in said adjacent non-seam regions of said base fabric.

38. An on-machine-seamable papermakers' fabric as claimed in claim 37 wherein said additional CD yarns are incorporated into said adjacent non-seam regions of said base fabric during the weaving thereof.

39. An on-machine-seamable papermakers' fabric as claimed in claim 37 wherein said additional CD yarns are inserted into said adjacent non-seam regions of said base fabric after the weaving thereof.

40. An on-machine-seamable papermakers' fabric as claimed in claim 37 wherein said additional CD yarns are sewn into said adjacent non-seam regions of said base fabric after the weaving thereof.

41. An on-machine-seamable papermakers' fabric as claimed in claim 37 wherein said additional CD yarns are selected from the group of yarn varieties consisting of monofilament, multifilament, texturized, braided, knitted and spun yarns.

42. An on-machine-seamable papermakers' fabric as claimed in claim 37 wherein said additional CD yarns include yarns having cross-sectional shapes selected from the group consisting of circular, oval, rectangular and lobed shapes.

43. An on-machine-seamable papermakers' fabric as claimed in claim 37 wherein said additional CD yarns are of the same type of yarn as said CD yarns.

44. An on-machine-seamable papermakers' fabric as claimed in claim 37 wherein said additional CD yarns are of a type of yarn different from said CD yarns.

45. An on-machine-seamable papermakers' fabric as claimed in claim 36 wherein said additional flow-resistant material is ribbons of woven material attached to said adjacent non-seam regions of said base fabric.

46. An on-machine-seamable papermakers' fabric as claimed in claim 45 wherein said ribbons of woven material are attached by sewing.

47. An on-machine-seamable papermakers' fabric as claimed in claim 45 wherein said ribbons of woven material are attached by an adhesive.

48. An on-machine-seamable papermakers' fabric as claimed in claim 36 wherein said additional flow-resistant material is ribbons of non-woven material attached to said adjacent non-seam regions of said base fabric.

49. An on-machine-seamable papermakers' fabric as claimed in claim 48 wherein said ribbons of non-woven material are attached by sewing.

50. An on-machine-seamable papermakers' fabric as claimed in claim 48 wherein said ribbons of non-woven material are attached by an adhesive.

51. An on-machine-seamable papermakers' fabric as claimed in claim 36 wherein said additional flow-resistant material is ribbons of polymeric film attached to said adjacent non-seam regions of said base fabric.

52. An on-machine-seamable papermakers' fabric as claimed in claim 51 wherein said ribbons of polymeric film are attached by sewing.

53. An on-machine-seamable papermakers' fabric as claimed in claim 51 wherein said ribbons of polymeric film are attached by an adhesive.

54. An on-machine-seamable papermakers' fabric as claimed in claim 36 wherein said additional flow-resistant material is a polymeric foam in said adjacent non-seam regions of said base fabric.

55. An on-machine-seamable papermakers' fabric as claimed in claim 36 wherein said additional flow-resistant material is a cured liquid resin in said adjacent non-seam regions of said base fabric.

56. An on-machine-seamable papermakers' fabric as claimed in claim 36 wherein said on-machine-seamable papermakers' fabric is joined into the form of an endless loop having an inside and an outside and further comprising an endless woven base fabric laminated to at least one of said inside and outside by at least one layer of staple fiber batt entangled therethrough.

57. An on-machine-seamable papermakers' fabric as claimed in claim 36 wherein said on-machine-seamable papermakers' fabric is joined into the form of an endless loop having an inside and an outside and further comprising a non-woven mesh laminated to at least one of said inside and outside by at least one layer of staple fiber batt entangled therethrough.

58. An on-machine-seamable papermakers' fabric as claimed in claim 36 wherein said on-machine-seamable papermakers' fabric is joined into the form of an endless loop having an inside and an outside and further comprising a spirally wound base fabric laminated to at least one of said inside and outside by at least one layer of staple fiber batt entangled therethrough.

* * * * *